US010844717B2

(12) United States Patent
Chen et al.

(10) Patent No.: US 10,844,717 B2
(45) Date of Patent: Nov. 24, 2020

(54) MECHANICAL CONSTANT-RESISTANCE SINGLE PROP CONTINUOUS PROP LIFTING PRE-TIGHTENING DEVICE AND METHOD

(71) Applicant: CHINA UNIVERSITY OF MINING AND TECHNOLOGY, Jiangsu (CN)

(72) Inventors: Yanlong Chen, Jiangsu (CN); Hai Pu, Jiangsu (CN); Feng Ju, Jiangsu (CN); Kai Zhang, Jiangsu (CN); Yu Wu, Jiangsu (CN); Ming Li, Jiangsu (CN); Jiangfeng Liu, Jiangsu (CN); Peng Wu, Jiangsu (CN); Jincheng Fan, Jiangsu (CN); Zhiwei Feng, Jiangsu (CN)

(73) Assignee: CHINA UNIVERSITY OF MINING AND TECHNOLOGY, Jiangsu (CN)

( * ) Notice: Subject to any disclaimer, the term of this patent is extended or adjusted under 35 U.S.C. 154(b) by 0 days.

(21) Appl. No.: 16/756,082

(22) PCT Filed: Mar. 12, 2019

(86) PCT No.: PCT/CN2019/077809
§ 371 (c)(1),
(2) Date: Apr. 14, 2020

(87) PCT Pub. No.: WO2019/166025
PCT Pub. Date: Sep. 6, 2019

(65) Prior Publication Data

US 2020/0240269 A1 Jul. 30, 2020

(30) Foreign Application Priority Data

Feb. 28, 2018 (CN) ..... 2018 1 0165456

(51) Int. Cl.
*E21D 15/59* (2006.01)
*E21D 15/58* (2006.01)
*E21D 15/60* (2006.01)

(52) U.S. Cl.
CPC ..... *E21D 15/585* (2013.01); *E21D 15/60* (2013.01)

(58) Field of Classification Search
CPC ... E21D 15/585; E21D 15/586; E21D 15/587; E21D 15/60; E21D 15/603
(Continued)

(56) References Cited

U.S. PATENT DOCUMENTS 2,657,009 A * 10/1953 Neis ..... B66F 1/08 254/93 R
3,030,889 A * 4/1962 Parker ..... B66F 3/24 417/429
4,915,281 A 4/1990 Berger et al.

FOREIGN PATENT DOCUMENTS

CN 2034966 U 3/1989
CN 2424185 Y 3/2001
(Continued)

OTHER PUBLICATIONS

International Search Report for Application No. PCT/CN2019/077809, dated Jun. 3, 2019.

*Primary Examiner* — Sunil Singh
(74) *Attorney, Agent, or Firm* — Marshall, Gerstein & Borun LLP

(57) ABSTRACT

A mechanical constant-resistance single prop continuous prop lifting pre-tightening device, structurally composed of a continuous prop lifting device, a pressurizing system, an oil supply line and a monitoring unit. The continuous prop lifting device is a core component, comprising a hydraulic cylinder, a prop barrel clamping sleeve ring and a prop rod clamping sleeve ring. The prop rod clamping sleeve ring is
(Continued)

fixedly connected with a piston rod of the hydraulic cylinder by means of a cylinder head seat, and the prop barrel clamping sleeve ring is fixedly connected with a cylinder body of the hydraulic cylinder. With continuous pressurization of the pressurizing system, a cohesion occurs between the continuous prop lifting device and a prop rod, so that the prop rod of a single prop is lifted up to come into contact with a top plate and provide a pre-tightening force.

4 Claims, 2 Drawing Sheets

(58) Field of Classification Search
USPC ..... 405/290, 302; 248/354.1; 254/93 R; 92/117 R
See application file for complete search history.

(56) References Cited

FOREIGN PATENT DOCUMENTS

| | | | |
|---|---|---|---|
| CN | 1640805 | A | 7/2005 |
| CN | 201212011 | Y | 3/2009 |
| CN | 101446214 | A | 6/2009 |
| CN | 105084244 | A | 11/2015 |
| CN | 107161903 | A | 9/2017 |
| CN | 108425693 | A | 8/2018 |

* cited by examiner

MECHANICAL CONSTANT-RESISTANCE SINGLE PROP CONTINUOUS PROP LIFTING PRE-TIGHTENING DEVICE AND METHOD

TECHNICAL FIELD

The present invention belongs to the technical field of engineering machinery, in particular to a continuous prop lifting pre-tightening device for mechanical constant-resistance single prop and a method thereof.

BACKGROUND ART

Mechanical constant-resistance single props are widely applied in the coal mine support field, owing to their characteristics including strong supporting ability, stable supporting effect, easy use, and low application cost, etc. How to apply pre-tightening force is a key factor influencing quick and effective roof supporting with mechanical constant-resistance single props. However, in the process of pre-tightening force application, prop lifting pre-tightening devices have to be removed and installed repeatedly to attain the purpose of applying pre-tightening force, owing to the limitation of the section height of roadway support and the extension length of cylinder piston rod. Such prop lifting pre-tightening devices are complex to operate and have poor stability.

Therefore, in order to improve the supporting performance of single props, it is an urgent task to improve single prop pre-tightening devices.

CONTENTS OF THE INVENTION

The object of the present invention is to provide a continuous prop lifting pre-tightening device for mechanical constant-resistance single prop and a method thereof, in order to solve the above-mentioned problems in the prior art. The device can attain the purpose of continuous prop lifting of a single prop for applying pre-tightening force, and is simple in structure and easy to operate.

To solve the above problems, the present invention provides the following technical scheme:

The object of the present invention is to provide a continuous prop lifting pre-tightening device for mechanical constant-resistance single prop, which comprises a continuous prop lifter, a pressurization system, an oil supply pipeline, and a monitoring unit; the continuous prop lifter is a core component and comprises a hydraulic oil cylinder, a prop casing clamping hoop, and a prop rod clamping hoop, wherein the prop rod clamping hoop is fixedly connected to a piston rod of the hydraulic oil cylinder via a cylinder head block, and the prop casing clamping hoop is fixedly connected to the cylinder tail of the cylinder body of the hydraulic oil cylinder; the pressurization system is a part of the continuous prop lifting pre-tightening device, and may employ a manual pressurizing pump or motor-driven pressurizing pump for pressurization; the oil supply pipeline comprises two oil pipes, the two ends of the oil pipes are connected to oil ports in the continuous prop lifter and the pressurization system respectively, and the two oil ports in the continuous prop lifter are arranged in the cylinder body of the hydraulic oil cylinder; the monitoring unit is a pressure meter arranged on the front end of the pressurization system.

The prop rod clamping hoop is an openable hoop, one side of the hoop is fixedly connected via a rotating shaft, and the other side of the hoop is equipped with a prop rod bolt hole. The prop rod clamping hoop is controlled to close or open through the connection and disconnection of a prop rod clamping bolt and a clamping nut with the prop rod bolt hole.

The prop casing clamping hoop is an openable hoop, one side of the hoop is fixedly connected via a rotating shaft, and the other side of the hoop is equipped with a prop casing bolt hole, and the prop casing clamping hoop is controlled to close or open through the connection and disconnection of a prop casing clamping bolt and a clamping nut with the prop casing bolt hole.

A removable conical bush is assembled inside the prop rod clamping hoop, and the removable conical bush is connected with the prop rod clamping hoop in a slidable mode via a stop bolt, i.e., the central part of a side of the prop rod clamping hoop has a groove in width slightly greater than the diameter of the stop bolt, so that the conical bush can move in the radial direction inside the prop rod clamping hoop.

The inner surface of the conical bush and the inner surface of the prop casing clamping hoop are concave-convex threaded structures, in order to increase the friction force between the conical bush and the prop casing clamping hoop and the single prop.

The present invention further provides a continuous prop lifting pre-tightening method for the mechanical constant-resistance single prop, comprising the following steps:

1) connecting the two ends of two oil pipes to oil ports in a continuous prop lifter and a pressurization system respectively;
2) removing prop rod clamping bolt and clamping nut, and prop casing clamping bolt and clamping nut, so that a prop rod clamping hoop and a prop casing clamping hoop are in an open state;
3) fitting the two leaves of the prop rod clamping hoop and the prop casing clamping hoop over a prop rod and a prop casing of the single prop respectively;
4) inserting the prop rod clamping bolt and the clamping nut, the prop casing clamping bolt and the clamping nut into the prop rod bolt hole and the prop casing bolt hole respectively, and closing and locking the prop rod clamping hoop and the prop casing clamping hoop respectively;
5) setting an oil circuit control switch in the pressurization system to "oil supply" position, the piston rod extends out under the continuous pressurization of the pressurization system, and a conical bush is squeezed and clutches the prop rod, and thereby the prop rod of the single prop clamped by the two hoops is lifted, meanwhile observing the indication on an pressure meter to ensure the indication is within a rated operating pressure range;
6) terminating the application of pre-tightening force if the force on the single prop reaches the preset pre-tightening force; if the single prop doesn't come into contact with the roof to be supported, setting the oil circuit control switch in the pressurization system to the "oil return" position and relieving the pressure continuously by means of the pressurization system, so that the piston rod retracts and the conical bush is decoupled from the prop rod; when the piston rod retracts completely, setting the oil circuit control switch in the pressurization system again to the "oil supply" position, and applying pressure continuously by means of the pressurization system again, so that the piston rod extends out again, the conical bush is squeezed and clutches the prop rod, and thereby the prop rod of the single prop clamped by the two hoops is lifted again;

7) terminating the application of pre-tightening force if the force on the single prop reaches the preset pre-tightening force; if the single prop still doesn't come into contact with the roof to be supported, repeating the step 6 till the preset pre-tightening force is reached.

The present invention has the following advantages and beneficial effects:

1. In the present invention, the piston rod of the continuous prop lifter is controlled to extend, stay, and retract by adjusting the oil circuit control switch in the pressurization system to different positions, and thereby the prop rod of the single prop is controlled to rise, and the purpose of continuous lifting of the single prop for applying pre-tightening force is attained;
2. The inner surface of the conical bush and the inner surface of the prop casing clamping hoop are concave-convex threaded structures, to increase the friction force between the conical bush and the prop casing clamping hoop and the single prop;
3. The prop lifting range of the device is not limited to the length of the piston rod of the prop lifter, and the device can realize prop lifting in several times, can be operated simply and quickly, and can be applied widely.

DESCRIPTION OF DRAWINGS

The structure of the continuous prop lifting pre-tightening device and the method thereof are described in detail in an embodiment in which the pressurization system is a manual pressurizing pump.

In the figures: 1—hydraulic oil cylinder; 2—oil pipe 1; 3—oil pipe 2; 4—oil circuit control switch; 5—manual pressurizing pump handle; 6—manual pressurizing pump oil tank; 7—prop casing clamping hoop; 8—prop rod clamping hoop; 9—piston rod; 10—rotating shaft; 11—conical bush; 12—stop bolt; 13—clamping bolt; 14—clamping nut; 15—cylinder head block; 16—manual pressurizing pump; 17—continuous prop lifter; 18—pressure meter.

EMBODIMENTS

The present invention discloses a continuous prop lifting pre-tightening device for mechanical constant-resistance single prop and the method thereof. The continuous prop lifting pre-tightening device for mechanical constant-resistance single prop comprises oil pipes, a continuous prop lifter, and a manual pressurizing pump. Two oil pipes are provided, and the two ends of the oil pipes are connected to oil ports in the continuous prop lifter and the manual pressurizing pump respectively. The continuous prop lifter comprises a hydraulic oil cylinder, a prop casing clamping hoop, and a prop rod clamping hoop, wherein the prop rod clamping hoop is fixedly connected to a piston rod of the hydraulic oil cylinder via a cylinder head block, and the prop casing clamping hoop is fixedly connected to the cylinder tail of the cylinder body of the hydraulic oil cylinder; the manual pressurizing pump is a power device for lifting the prop rod of the single prop. In the present invention, the piston rod of the continuous prop lifter is controlled to extend, stay, and retract by adjusting the oil circuit control switch in the manual pressurizing pump to different positions, and thereby the prop rod of the single prop is controlled to rise, and the purpose of continuous prop lifting of the single prop for applying pre-tightening force is attained.

Hereunder the present invention will be further detailed in embodiments, with reference to the accompanying drawings.

Figure 1:
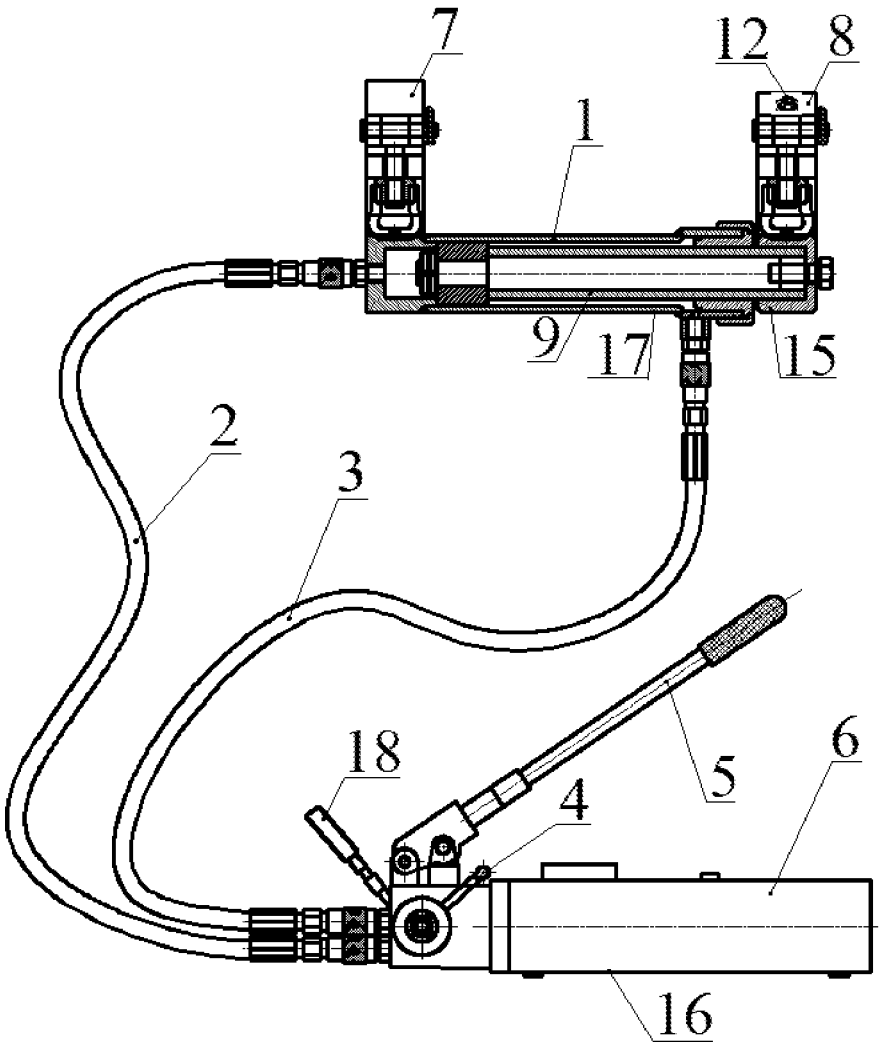
FIG. 1 is a schematic diagram of the overall structure of the continuous prop lifting pre-tightening device in the present invention.

As shown in FIG. 1, the continuous prop lifting pre-tightening device for mechanical constant-resistance single prop in the present invention comprises a continuous prop lifter (17), a manual pressurizing pump (16), an oil supply pipeline (2) and an oil supply pipeline (3), and a pressure meter (18), etc. The continuous prop lifter (17) is the core component and comprises a hydraulic oil cylinder (1), a prop casing clamping hoop (7), and a prop rod clamping hoop (8), wherein the prop rod clamping hoop (8) is fixedly connected to a piston rod (9) of the hydraulic oil cylinder (1) via a cylinder head block (15), and the prop casing clamping hoop (7) is fixedly connected to the cylinder body of the hydraulic oil cylinder (1); the oil supply pipeline comprises oil pipe (2) and oil pipe (3), the two ends of the oil pipe (2) and oil pipe (3) are connected to oil ports in the continuous prop lifter (17) and the manual pressurizing pump (16) respectively, and the two oil ports in the continuous prop lifter (17) are arranged in the cylinder body of the hydraulic oil cylinder (1); the pressure meter (18) is used to monitor the indicated value of pressurization.

Figure 2:
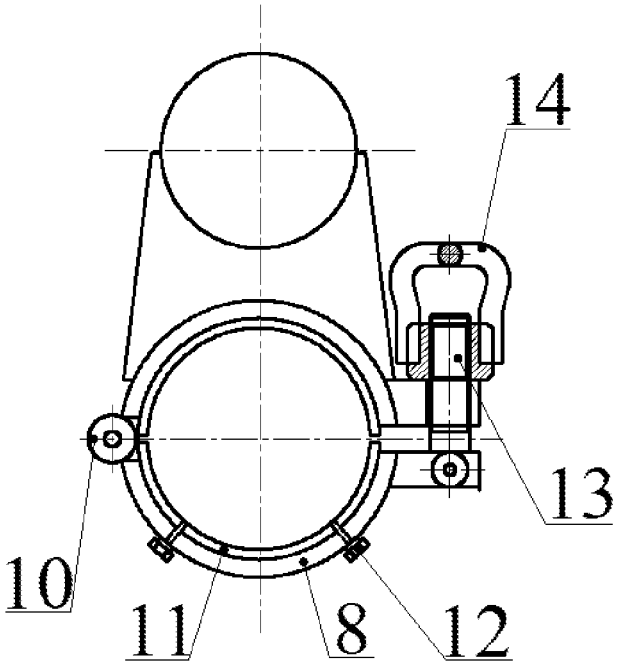
FIG. 2 is a schematic structural diagram of the prop rod clamping hoop in the present invention.

As shown in FIG. 2, the prop rod clamping hoop (8) is an openable hoop, one side of the hoop is fixedly connected via a rotating shaft (10), and the other side of the hoop is provided with a prop rod bolt hole. The prop rod clamping hoop (8) is controlled to close or open by means of connection and disconnection of the prop rod clamping bolt (13) and the clamping nut (14) with the prop rod bolt hole.

Figure 3:
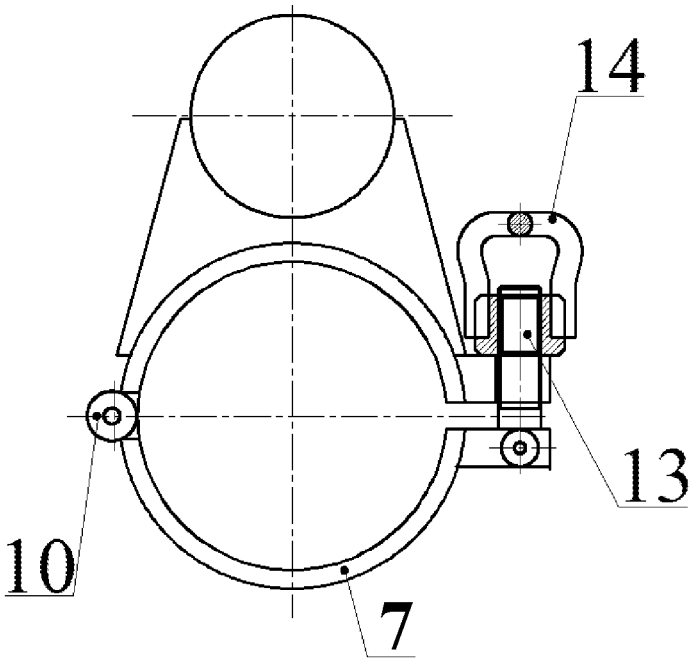
FIG. 3 is a schematic structural diagram of the prop casing clamping hoop in the present invention.

As shown in FIG. 3, the prop casing clamping hoop (7) is an openable hoop, one side of the hoop is fixedly connected via a rotating shaft (10), and the other side of the hoop is provided with a prop casing bolt hole, and the prop casing clamping hoop (7) is controlled to close or open by means of connection and disconnection of the prop casing clamping bolt (13) and the clamping nut (14) with the prop casing bolt hole.

A removable conical bush (11) is assembled inside the prop rod clamping hoop (8), and the conical bush is connected with the prop rod clamping hoop (8) in a slidable mode via a stop bolt (12), i.e., the central part of a side of the prop rod clamping hoop has a groove in width slightly greater than the diameter of the stop bolt, so that the conical bush can move in the radial direction inside the prop rod clamping hoop.

The inner surface of the conical bush (11) and the inner surface of the prop casing clamping hoop (7) are concave-convex threaded structures, to increase the friction force between the conical bush and the prop casing clamping hoop and the single prop.

The manual pressurizing pump (16) comprises an oil circuit control switch (4), a pressure meter (18), a manual pressurizing pump oil tank (6), and a manual pressurizing pump handle (5). The oil circuit control switch (4) has an oil supply position, a neutral position, and an oil return position, and the piston rod (9) of the continuous prop lifter (17) can be controlled to extend, stay, and retract by adjusting the position of the oil circuit control switch (4); the manual pressurizing pump oil tank (6) provides a space for oil supply and oil storage; the pressurizing pump handle (5) is an external auxiliary structure for providing power to the entire device.

The monitoring unit is a pressure meter (18) disposed on the front end of the manual pressurizing pump and used to monitor the indicated value of pressurization.

The present invention further provides a continuous prop lifting pre-tightening method for mechanical constant-resistance single prop, which comprises the following steps:

1) connecting the two ends of an oil pipe (2) and the two ends of an oil pipe (3) to oil ports of a continuous prop lifter (17) and a manual pressurizing pump (16);
2) removing prop rod clamping bolt (13) and clamping nut (14), and prop casing clamping bolt (13) and clamping nut (14), so that a prop rod clamping hoop (8) and a prop casing clamping hoop (7) are in an open state;
3) fitting the two leaves of the prop rod clamping hoop (8) and the prop casing clamping hoop (7) over the prop rod and the prop casing of the single prop respectively;
4) inserting the prop rod clamping bolt (13) and the clamping nut (14), the prop casing clamping bolt (13) and the clamping nut (14) into the prop rod bolt hole and the prop casing bolt hole respectively, closing and locking the prop rod clamping hoop (8) and the prop casing clamping hoop (7) respectively;
5) setting the oil circuit control switch (4) in an manual pressurizing pump (16) to an oil supply position, and pressurizing continuously by means of a manual pressurizing pump handle (5), so that the piston rod (9) extends out and a conical bush (11) is squeezed and clutches the prop rod, thereby the prop rod of the single prop clamped by the two hoops is lifted, meanwhile, observing the indication on an pressure meter (18) to ensure the indication is within a rated operating pressure range;
6) terminating the application of pre-tightening force if the force on the single prop reaches preset pre-tightening force; if the single prop doesn't come into contact with the roof to be supported, adjusting the oil circuit control switch (4) in the manual pressurizing pump (16) to an oil return position and relieving the pressure continuously by means of the manual pressurizing pump handle (5), so that the piston rod (9) retracts and the conical bush (11) is decoupled from the prop rod; when the piston rod (9) retracts completely, setting the oil circuit control switch (4) in the manual pressurizing pump (16) to the oil supply position, and applying pressure continuously by means of the manual pressurizing pump handle (5) again, so that the piston rod (9) extends out again, the conical bush (11) is squeezed and clutches the prop rod, thereby the prop rod of the single prop clamped by the two hoops is lifted again;
7) terminating the application of pre-tightening force if the force on the single prop reaches the preset pre-tightening force; if the single prop still doesn't come into contact with the roof to be supported, repeating the step 6 till the preset pre-tightening force is reached.

The present invention plays a key role in the support withdrawal technique for the working face 8216 in a coal mine. In the withdrawal process of the working face 8216, mechanical single props and timber cribs are used in combination for support, high constant pre-tightening force is applied to the mechanical single props timely and quickly with continuous prop lifters. Thus, the shield supports are withdrawn safely, and the roof collapses fully after the supports are withdrawn to a certain distance.

The working face 8216 is in 4 m height, the initial installation length of the single prop is 3.5 m, and the maximum extension length of the piston rod of the continuous prop lifter is 0.4 m. After a run of prop lifting is finished, the prop rod of the single prop hasn't come into contact with the roof yet. By adjusting the pressurization system, the piston rod retracts and then extends out again, and thereby the prop rod of the single prop comes into contact with the roof and applies pre-tightening force. The magnitude of the pre-tightening force is monitored by the monitoring unit, and is controlled at about 100 kN in the actual pre-tightening force application process.

While the present invention is described above in some preferred embodiments, it should be noted that those skilled in the art can make various improvements and modifications without departing from the principle of the present invention, and those improvements and modifications should be deemed as falling in the scope of protection of the present invention.

The invention claimed is:

1. A continuous prop lifting pre-tightening device for mechanical constant-resistance single prop, comprising a continuous prop lifter, a pressurization system, an oil supply pipeline, and a monitoring unit, wherein the continuous prop lifter is a core component and comprises a hydraulic oil cylinder, a prop casing clamping hoop, and a prop rod clamping hoop, both the prop casing clamping hoop and the prop rod clamping hoop are disposed vertically above the hydraulic oil cylinder at the cylinder tail and cylinder head of the hydraulic oil cylinder respectively, the prop rod clamping hoop is fixedly connected to a piston rod of the hydraulic oil cylinder via a cylinder head block, and the prop casing clamping hoop is fixedly connected to the tail part of the cylinder body of the hydraulic oil cylinder; the oil supply pipeline comprises oil pipes and, the two ends of the oil pipes and are connected to oil ports of the continuous prop lifter and the pressurization system respectively, and the two oil ports of the continuous prop lifter are arranged in the cylinder body of the hydraulic oil cylinder, wherein the oil port connected to the oil pipe is at the cylinder tail, and the oil port connected to the oil pipe is in the cylinder body near the cylinder head block; the pressurization system employs a manual pressurizing pump or motor-driven pressurizing pump for pressurization; the monitoring unit is a pressure meter arranged on the front end of the pressurization system and wherein the prop rod clamping hoop is an openable hoop, one side of the hoop is fixedly connected via a rotating shaft, and (a) the other side of the hoop is provided with a prop rod bolt hole, and the prop rod clamping hoop is controlled to close or open by means of connection and disconnection of a prop rod clamping bolt and a clamping nut with the prop rod bolt hole or (b) the other side of the hoop is provided with a prop casing bolt hole, and the prop casing clamping hoop is controlled to close or open by means of connection and disconnection of a prop casing clamping bolt and a clamping nut with the prop casing bolt hole.

2. The continuous prop lifting pre-tightening device for mechanical constant-resistance single prop according to claim 1, wherein a removable conical bush is assembled inside the prop rod clamping hoop, and the conical bush is connected with the prop rod clamping hoop in a slidable mode via a stop bolt, i.e., the central part of a side of the prop rod clamping hoop has a groove in width greater than the diameter of the stop bolt.

3. The continuous prop lifting pre-tightening device for mechanical constant-resistance single prop according to claim 2, wherein the outer surface of the conical bush and the inner surface of the prop casing clamping hoop are convex-concave threaded structures.

4. A continuous prop lifting pre-tightening method for mechanical constant-resistance single prop having a piston rod, comprising the following steps:

1) connecting the two ends of an oil pipe and the two ends of an oil pipe to oil ports of a continuous prop lifter and a manual pressurizing pump;
2) removing prop rod clamping bolt and clamping nut, and prop casing clamping bolt and clamping nut, so that a prop rod clamping hoop and a prop casing clamping hoop having two leaves are in an open state;
3) fitting the two leaves of the prop rod clamping hoop and the prop casing clamping hoop over a prop rod and a prop casing of the single prop respectively;
4) inserting the prop rod clamping bolt and the clamping nut, the prop casing clamping bolt and the clamping nut into the prop rod bolt hole and the prop casing bolt hole respectively, closing and locking the prop rod clamping hoop and the prop casing clamping hoop respectively;
5) setting an oil circuit control switch in an manual pressurizing pump to an oil supply position, and pressurizing continuously by means of a manual pressurizing pump handle, so that the piston rod extends out and a conical bush assembled inside the prop rod clamping hoop is squeezed and clutches the prop rod, and thereby the prop rod of the single prop is lifted, meanwhile, observing the indication on an pressure meter to ensure the indication is within a rated operating pressure range;
6) terminating the application of pre-tightening force if the force on the single prop reaches preset pre-tightening force; if the single prop doesn't come into contact with the roof to be supported, setting the oil circuit control switch in the manual pressurizing pump to an oil return position and relieving the pressure continuously by means of the manual pressurizing pump handle, so that the piston rod retracts and the conical bush is decoupled from the prop rod; when the piston rod retracts completely, setting the oil circuit control switch in the manual pressurizing pump to the oil supply position, and applying pressure continuously by means of the manual pressurizing pump handle again, so that the piston rod extends out again, the conical bush assembled inside the prop rod clamping hoop is squeezed and clutches the prop rod, and thereby the prop rod of the single prop is lifted again;
7) terminating the application of pre-tightening force if the force on the single prop reaches the preset pre-tightening force; if the single prop still doesn't come into contact with the roof to be supported, repeating the step 6 till the preset pre-tightening force is reached.

* * * * *